US006561863B1

(12) United States Patent
Campbell

(10) Patent No.: US 6,561,863 B1
(45) Date of Patent: May 13, 2003

(54) PRESSURE ACTUATED TRIGGERING SYSTEM

(76) Inventor: Richard A. Campbell, 3415 Stanwood Blvd., Huntsville, AL (US) 35811

( * ) Notice: Subject to any disclaimer, the term of this patent is extended or adjusted under 35 U.S.C. 154(b) by 0 days.

(21) Appl. No.: 09/983,342

(22) Filed: Oct. 24, 2001

Related U.S. Application Data

(63) Continuation of application No. 09/607,340, filed on Jun. 30, 2000, now abandoned.

(60) Provisional application No. 60/142,060, filed on Jul. 2, 1999, provisional application No. 60/149,720, filed on Aug. 20, 1999, and provisional application No. 60/151,928, filed on Sep. 1, 1999.

(51) Int. Cl.[7] ..... B63C 9/125; B63C 9/15

(52) U.S. Cl. ..... 441/93; 441/10

(58) Field of Search ..... 441/10, 92, 93; 222/5

(56) References Cited

U.S. PATENT DOCUMENTS

| | | | | |
|---|---|---|---|---|
| 2,946,484 | A | 7/1960 | Stoner | |
| 3,298,571 | A | 1/1967 | Novak | |
| 3,349,786 | A | 10/1967 | Martin | 137/68 |
| 4,500,014 | A | 2/1985 | Zimmerly | 222/5 |
| 4,582,494 | A | 4/1986 | Becnel | 441/95 |
| 4,635,754 | A | 1/1987 | Aschauer et al. | 441/93 |
| 5,518,430 | A | 5/1996 | Crowder et al. | 441/93 |

FOREIGN PATENT DOCUMENTS

| | | |
|---|---|---|
| WO | WO 00/02438 | 1/2000 |

OTHER PUBLICATIONS

Notification of Transmittal of the International Search Report of the Declaration dated Oct. 24, 2000.

*Primary Examiner*—Sherman Basinger
(74) *Attorney, Agent, or Firm*—McDermott, Will & Emery

(57) ABSTRACT

The system and method of the present invention provides an inflation device, such as a life preserver, that is automatically actuated by hydrostatic pressure. A diaphragm that is moveably responsive to fluid force created by fluid pressure actuates a first stage for providing a first force, that in response, actuates a second stage for providing a second force. The second force provided by the second stage is transferred by a force translation system to pistons, which in turn puncture $CO_2$ cartridges. The punctured $CO_2$ cartridges then release stored $CO_2$ and inflate a previously deflated life preserver.

2 Claims, 15 Drawing Sheets

PRESSURE ACTUATED TRIGGERING SYSTEM

This application is a continuation of application Ser. No. 09/607,340 filed Jun. 30, 2000, abandoned, which claims priority from Provisional Applications Ser. No. 60/142,060 filed Jul. 2, 1999, 60/149,720 filed Aug. 20, 1999 and 60/151,928 filed Sep. 1, 1999.

FIELD OF THE INVENTION

The present invention generally relates to a system and method for deploying an automatic inflation device. More particularly, the invention relates to a system and method for deploying an automatic inflation device with hydrostatic pressure. Even more particularly, the present invention relates to a system and method for deploying an automatic inflation device with a plurality of consecutive triggering stages wherein the first triggering stage is actuated by hydrostatic pressure.

BACKGROUND OF THE INVENTION

There are a number of situations and circumstances that require the multiplication of a first force into a second force. For example, it may be necessary to transform a relatively weak force into a relatively strong force. It may also be necessary to transform a large force into a smaller force. Such applications require a "force transformer" to accomplish the desired transformation. The force transformer includes a triggering mechanism for receiving a first force of a first level and actuating a transformation means, transformation means, and actuating means for applying a second force of a second level.

A force transformer that converts a small force into a larger force is referred to as a "force multiplier". A force multiplier converts a received force of a first low level into an output force of a second higher level. In many cases, the applied low level force is used as a triggering force to activate the force multiplier. The force multiplier, when activated, provides a higher level actuating force to perform a desired function. An example of a force-multiplying system is the power steering system of an automobile, which transforms the relatively low force arm movements of a driver to more powerful forces for turning the wheels of the car.

Other applications for force multipliers include those that rely on atmospheric, hydrostatic, or mechanical pressure to trigger the application of a large force. One such application involves the flotation, marking, and retrieval of inadvertently-submerged objects to which the device is attached based upon actuation by hydrostatic pressure corresponding to a preselected depth.

Full life jackets or personal flotation devices, while effective to support a person in the water, in some cases even where the person is unconscious, are generally bulky and uncomfortable to wear and because of this are not commonly available in an emergency use situation. Therefore many forms of inflatable life-saving aids or personal buoyancy aids have been provided in the past designed to be compact when not in use and inflated when in use, such as for example in an emergency situation where a person unexpectedly falls into a body of water.

Automatic flotation devices employing hydrostatic pressure-activated mechanisms for initiation of inflation of flotation elements from compressed gas sources have been proposed for the flotation, marking, and retrieval of inadvertently-submerged objects. Among such objects considered for flotation have been relatively small items, such as fishing rods and reels and firearms. Among those considered for marking and retrieval have been relatively larger items, such as outboard motors and boats.

Such devices typically consist of a pressure sensing means, a gas storage means, a gas release means that is responsive to the pressure sensing means, and a bladder or balloon that is inflated with the released gas to provide buoyancy, causing the balloon to float to the surface, marking the position of the submerged object or lifting the submerged object to at or near the surface.

A common drawback in the designs of the various mechanisms proposed for such flotation, marking, and retrieval has been the size or the mechanical inefficiency of their actuation mechanisms. Initiation of the inflation sequence in any compressed gas device involves piercing a metal seal on the gas container supplying the inflation gas. The piercing of the seal requires, typically, a relatively high pre-load spring force to drive the piercing implement through the seal. Because the spring-armed piercing mechanism must be restrained from moving before actuation by a force equal to that to which it has been armed, a significant force is required at actuation to overcome the friction inherent in the restraining mechanism. Because the actuation force in a hydrostatically-activated apparatus is derived from its pressure-responsive diaphragm, and because the level of that force is directly related to the surface area of its diaphragm and the depth of water, the relatively high actuation forces required in compressed gas devices have caused such apparati to be of impractical or undesirably large size in order to ensure reliable actuation.

A prior art device intended for the flotation of inadvertently-submerged objects and based upon hydrostatic actuation of inflation of flotation elements with compressed gas is described in U.S. patent to McNamee, U.S. Pat. No. 5,813,891. McNamee uses a water soluble table for actuating an automatic inflation device. A major problem with the device of McNamee is that the device may be activated by mere exposure to moisture, such as for example ancillary sea spray or humidity. As such, the device of McNamee is impractical for use in an inflatable life preserver that is stored on a sea faring vessel.

Another prior art device intended for the flotation of inadvertently-submerged objects and based upon hydrostatic actuation of inflation of flotation elements with compressed gas is described in U.S. patent to Crowder et al., U.S. Pat. No. 5,518,430. Crowder teaches a multi-stage triggering mechanism actuated by hydrostatic pressure, for use in an automatic inflation device. The structure of the Crowder device directs a plurality counter-directed nested stages to provide a means to puncture a stored gas cartridge. Problem with the Crowder device resides in its structure and function. Specifically, once the stored gas cartridge is punctured by a pin, the gas stored in the cartridge is inhibited from escaping because the pin is occupying the newly punctured hole. Consequently, deployment time of the inflation device is drastically lengthy. Another problem with the structure of the Crowder device is that the nested stages are counter-directed. As such, the device is impractical for manufacturing. Furthermore, the Crowder device lacks any measures for preventing unwanted firing of the triggering mechanism resulting in blunt trauma to the system, for example, when the system is dropped. Consequently, the Crowder device is prone to firing when accidentally dropped or jarred.

None of the above described prior art systems provide a triggering system for use in conjunction with an automatic inflation device that is not effected by humidity, is easily manufactured, is not prone to firing when dropped or jarred, and is quickly deployable.

What is needed is a triggering system for use in conjunction with an automatic inflation device that is not effected by humidity, is easily manufactured, and is not prone to firing when dropped or jarred. Further, what is needed is an automatic inflation device that is quickly deployable.

SUMMARY OF THE INVENTION

It is an object of this invention to provide triggering system for use in conjunction with an automatic inflation device that is not effected by humidity and is easily manufactured.

It is another object of this invention to a pressure actuated triggering system that is actuated under a predetermined amount of hydrostatic pressure.

It is yet another object of this invention to provide a system for generating a sufficient force to pierce a gas filled cartridge and to provide a system for transmitting the force to the gas filled cartridge without counterdirecting any intervening forces.

It is a further object of this invention to provide automatic inflation device that is quickly deployable.

In general, in one aspect, the invention features a triggering system comprising a cap for permitting fluid transfer from outside the triggering system to the inside the triggering system, a diaphragm adjacent to the cap, the diaphragm being moveably responsive to fluid force created by fluid transferred through the cap, a first stage adjacent to the pressure responsive diaphragm, the first stage being moveably responsive to force created by movement of the diaphragm, a second stage adjacent to the first stage, the second stage being moveably responsive to a force created by responsive movement of the first stage, a force transfer mechanism adjacent to the second stage, the force transfer mechanism being laterally moveably responsive to a force created by responsive movement of the second stage, a piston adjacent to the force transfer mechanism, the piston laterally moveably responsive to movement of the force transfer mechanism, and a housing containing the first stage, the second stage, the force transfer mechanism, and the piston.

Further, the triggering system of the first embodiment may additionally comprise a fluid filed cartridge adjacent to the piston, the fluid filed cartridge being punctured by the piston resulting from the movement of the piston. More particularly, the triggering system may additionally comprise a plurality of fluid filed cartridges adjacent to a respective plurality of pistons, wherein each of the fluid filed cartridges are punctured by its respective piston resulting from the movement of the respective pistons.

A triggering system in accordance with a second embodiment of the present invention may comprise a diaphragm being moveably responsive to fluid force created by fluid pressure, a stage moveably responsive to a force created by responsive movement of the diaphragm, a force transfer mechanism moveably responsive to a force created by firing of the stage, the force transfer mechanism transfers the force created by responsive movement of the stage in a transverse direction, a piston that is moveably responsive to a force from the force transfer mechanism.

Further, the triggering system of the second embodiment may additionally comprise a cap covering the diaphragm, the cap permitting fluid transfer from outside the triggering system to inside the triggering system.

Still further, in the triggering system of the second embodiment, the stage may further comprise a plurality of nested sub-stages.

A force transfer mechanism in accordance with one embodiment of the present invention having a length and a width, and being longitudinally moveable responsive to a force from a lateral direction, comprises a plane inclined at an angle with respect to the longitudinal direction of the force transfer mechanism, the plane receiving the force from a direction lateral to the force transfer mechanism, and a piston manipulation area comprising a first cavity for accommodating a piston that is moveable in a direction perpendicular to the longitudinal direction of the force transfer mechanism, a first lip adjacent the first cavity, the first lip shaped so as to move the piston for a predetermined distance, in a first direction normal to the longitudinal direction of the force transfer mechanism, when the force transfer mechanism is longitudinally moved a first predetermined distance in response to the force, a second cavity for accommodating the piston that is moveable in a direction perpendicular to the longitudinal direction of the force transfer mechanism, the first cavity and the second cavity being separated in a longitudinal direction by the first lip, a second lip adjacent the second cavity, the lip shaped so as to move the piston for a predetermined distance, in a second direction normal to the longitudinal direction of the force transfer mechanism, the second direction normal to the longitudinal direction of the force transfer mechanism being opposite to the first direction normal to the longitudinal direction of the force transfer mechanism, after the force transfer mechanism has longitudinally moved a first predetermined distance in response to the force, and when the force transfer mechanism is longitudinally moved a second predetermined distance in response to the force.

A force transfer mechanism in accordance with one embodiment of the present invention may further comprise a plurality of piston manipulation areas.

A method of manufacturing a force transfer mechanism in accordance with one embodiment of the present invention may comprise the steps of providing a housing having a first port, and a second port, inserting a piston into the housing via the second port, inserting a force transfer mechanism into the housing via the second port, inserting a stage into the first port, and attaching a diaphragm over the first port.

The triggering system in conjunction with an automatic inflation device of the present invention is not effected by humidity, is easily manufactured, and is not prone to firing when dropped or jarred. Further, triggering system in conjunction with an automatic inflation device of the present invention is quickly deployable.

The advantage of the invention may include hydrostatic actuation, thereby eliminating unwanted actuation resulting from humidity or ancillary sea spray. Another advantage of the invention may include ease of manufacture. Yet anther advantage of the present invention may include decreased deployment time of the inflation device.

Other features and advantages of the invention will become apparent from the following description and from the claims.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

In the following description, for the purposes of explanation, numerous specific details are set forth in order to provide a more thorough understanding of the present invention. It will be apparent, however, to one skilled in the art that the present invention may be practiced without these specific details.

In general, the system and method of the present invention provide a pressure actuated triggering system. More particularly, the present invention provides a pressure actuated multi-stage triggering system. Still more particularly, the present invention provides a pressure actuated multi-stage triggering system for triggering a fluid purging system. An exemplary working embodiment of the present invention provides a hydrostatic pressure actuated, two-stage triggering system for triggering a compressed gas cartridge purging system, wherein the triggering system and the purging system are used in conjunction with an inflatable device, such as for example, a life preserver to create an automatically inflatable life preserver.

The below detailed discussion of the exemplary working embodiment of the present invention additionally provides a detailed discussion of each of an exemplary triggering system and an exemplary fluid purging system.

Figure 1:
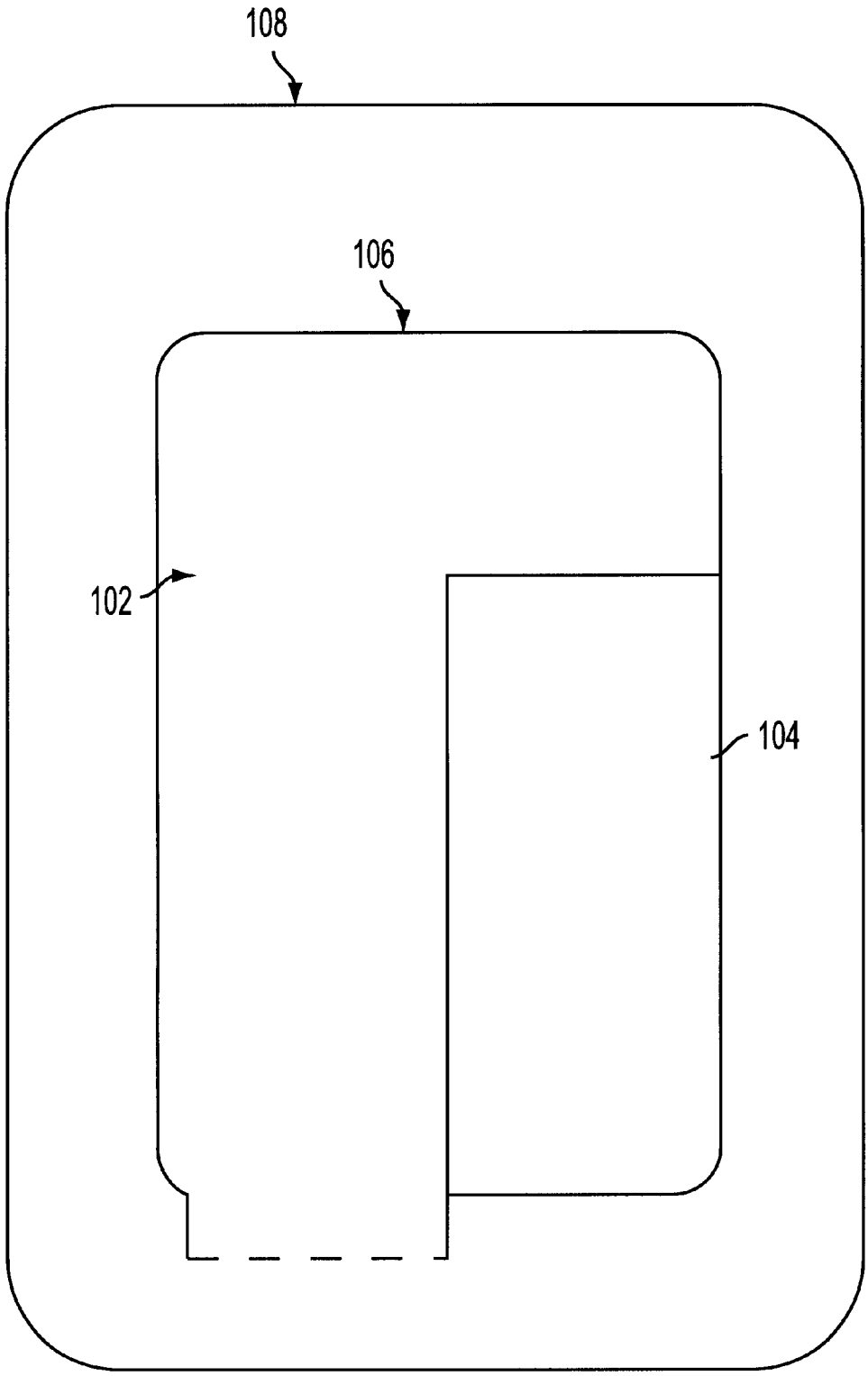
FIG. 1 illustrates an automatic inflatable device in accordance with an exemplary embodiment of the present invention.

As illustrated in FIG. 1, the hydrostatic pressure actuated, two-stage triggering system 102 and the compressed gas cartridge purging system 104, are housed in a housing 106, which is attached to the inflatable device 108. The triggering system may consist of subassemblies. In the exemplary working embodiment of the present invention, the triggering system consists of a first stage and second stage.

Figure 2:
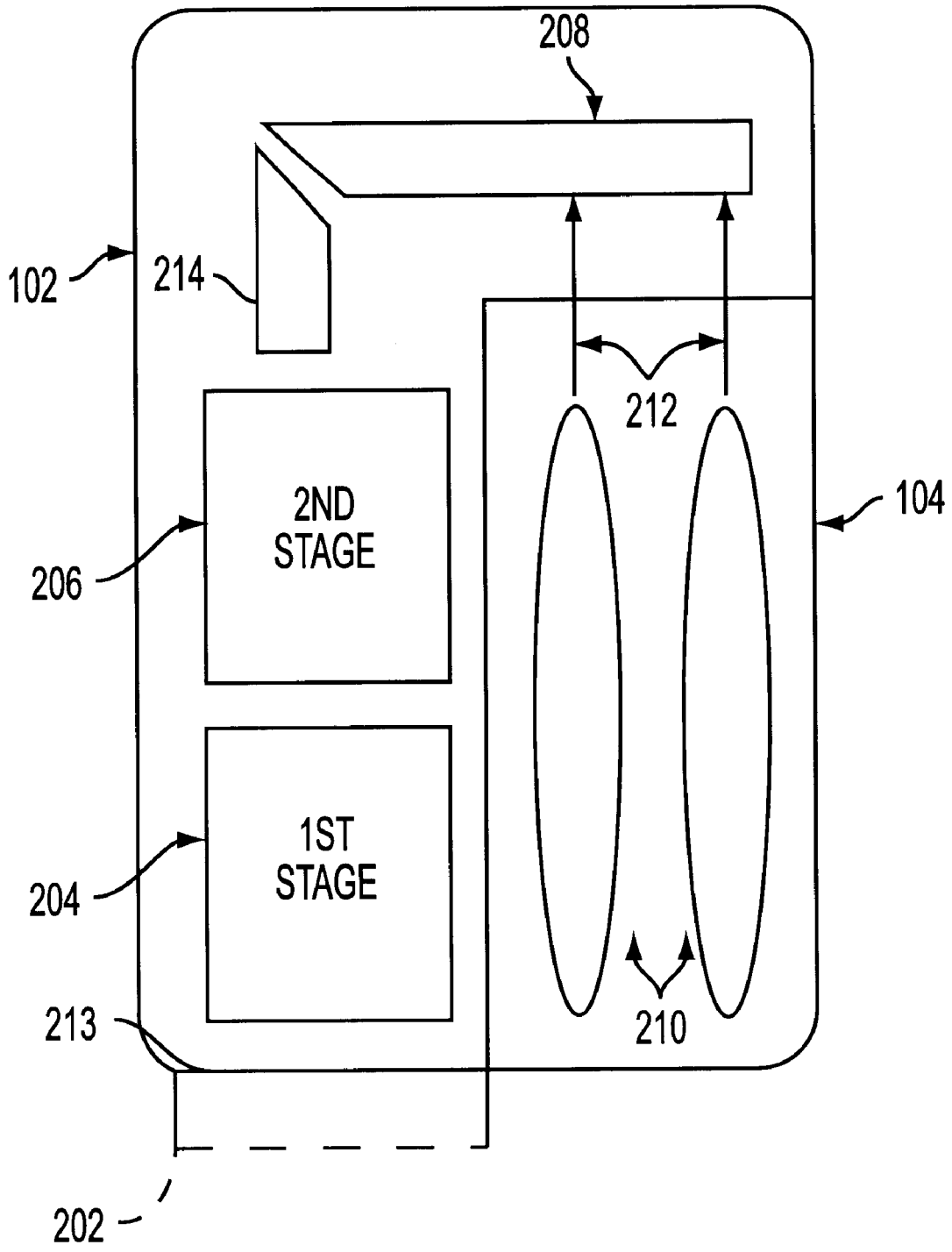
FIG. 2 illustrates a two-stage triggering system and a compressed gas cartridge purging system in accordance with an exemplary embodiment of the present invention.

As illustrated in FIG. 2, the two-stage triggering system 102 includes a perforated cap 202, a pressure responsive diaphragm 213, a first stage 204, and a second stage 206. The compressed gas cartridge purging system 104 includes a force transfer mechanism 208, push rod 214, fluid filed cartridges 210, and pistons 212.

Figure 3:
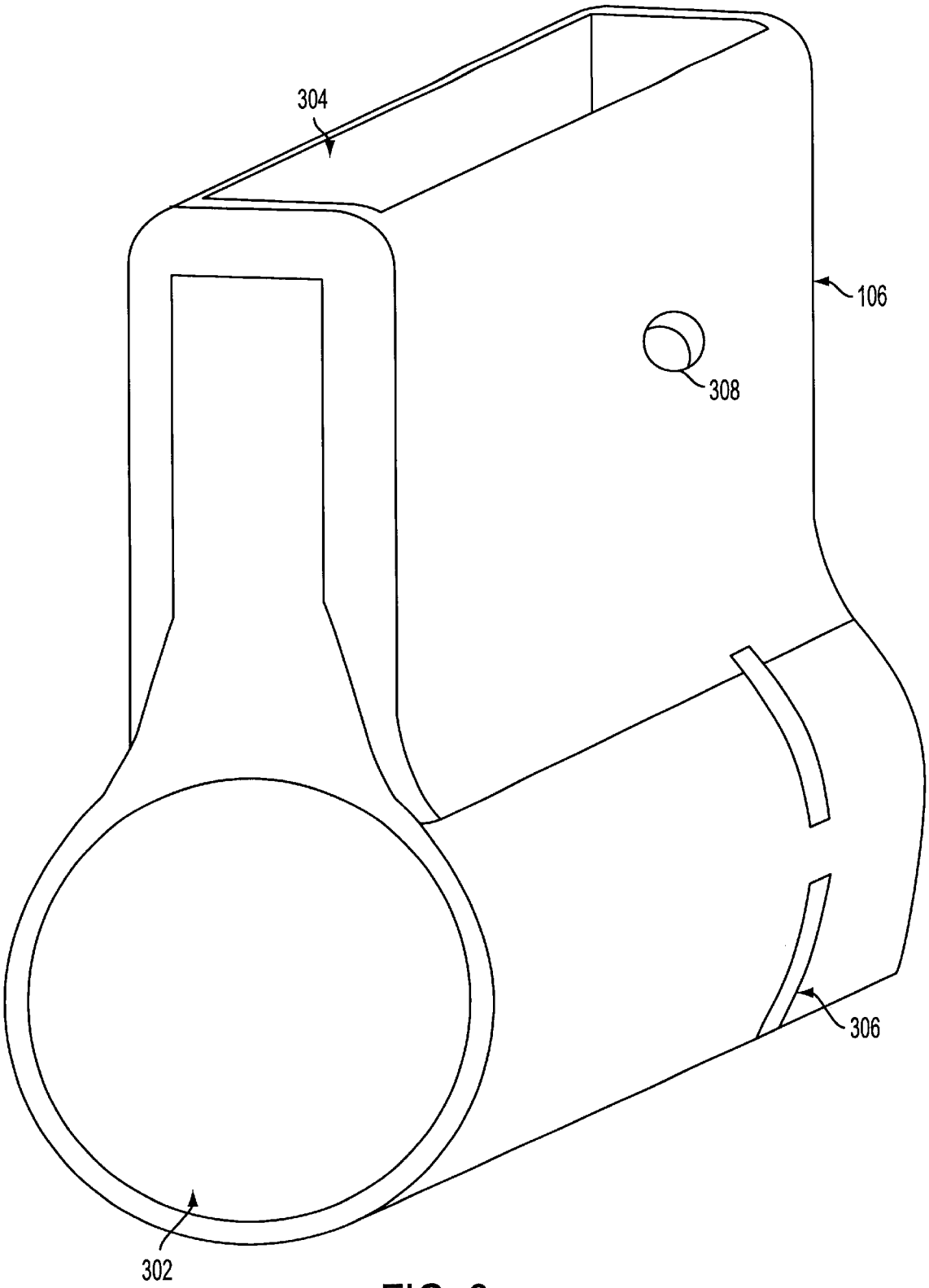
FIG. 3 illustrates the housing that accommodates all the subassemblies in accordance with an exemplary embodiment of the present invention.

FIG. 3 depicts an oblique view of an exemplary working embodiment of the housing 106 that accommodates all the subassemblies. The housing 106 includes a subassembly port 302, for the armed subassemblies, a fluid purging system port 304, for arming the fluid purging system, a window 306, and a fluid exit port 308. The window 306, for example a circumferential slot, permits visual determination of the operational status of the device. Further, window 306 may be covered by a transparent material thereby creating a water resistant seal. The housing 106 may additionally include a multi-operational status indicator, for viewing through window 306. A non-limiting example of such an indicator may include a multicolored moveable sleeve, wherein each color represents a respective operational status of the triggering system. For example, a red portion of the second stage within the housing that is viewable from the window may indicate a "fired" operational status, whereas a green portion of the second stage within the housing that is viewable from the window may indicate a "armed" operational status.

An exemplary embodiment of the two-stage triggering system 102 will now be described with reference to FIG. 4 through FIG. 10.

Figure 4:
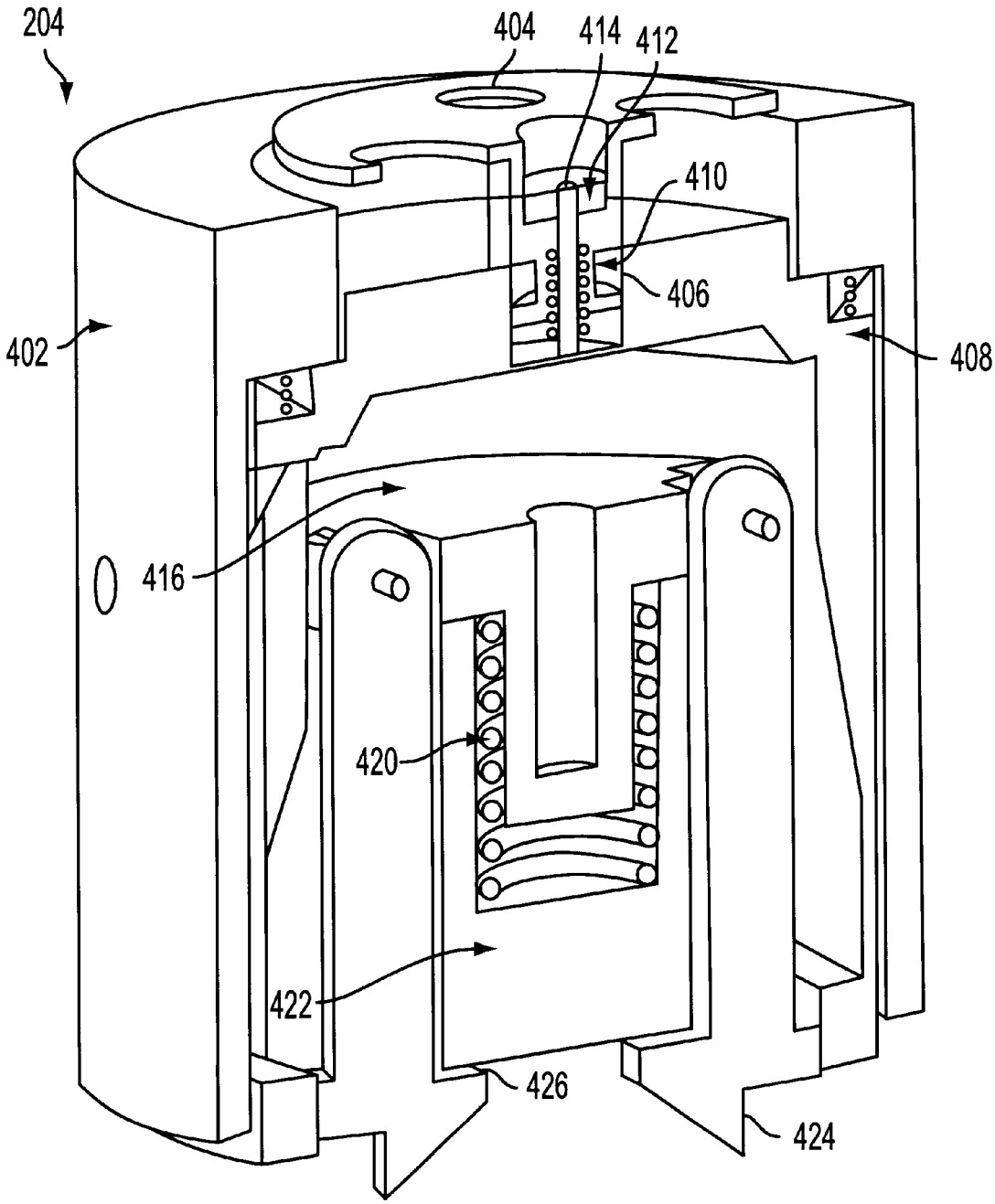
FIG. 4 illustrates an oblique view of a first stage of the triggering system in an armed condition in accordance with an exemplary embodiment of the present invention.

FIG. 4 illustrates an exemplary embodiment of the first stage 204 of the triggering system 102 in accordance with the present invention. The first stage 204 includes a first stage body 402. The trigger 404 is position in a bore 406 in a first stage arm retaining shell 408. A trigger spring 410 biases the trigger 404 into its distal position, the trigger spring's spring rate and pre-load determine the magnitude of the pressure at which the device will trigger. For example, if actuated by the deformable diaphragm 213 (not shown) being deformed by hydrostatic pressure, the magnitude of hydrostatic pressure is based on the submersion depth. In the exemplary working embodiment of the present invention, the water submersion depth for actuating the trigger is approximately 10–12 inches. The pre-load of trigger spring 410 is set by the position of the trigger restraint cap 412 on shaft 414, wherein the shaft 414 may be an integral part of the first stage arm restraining shell 408.

Figure 5:
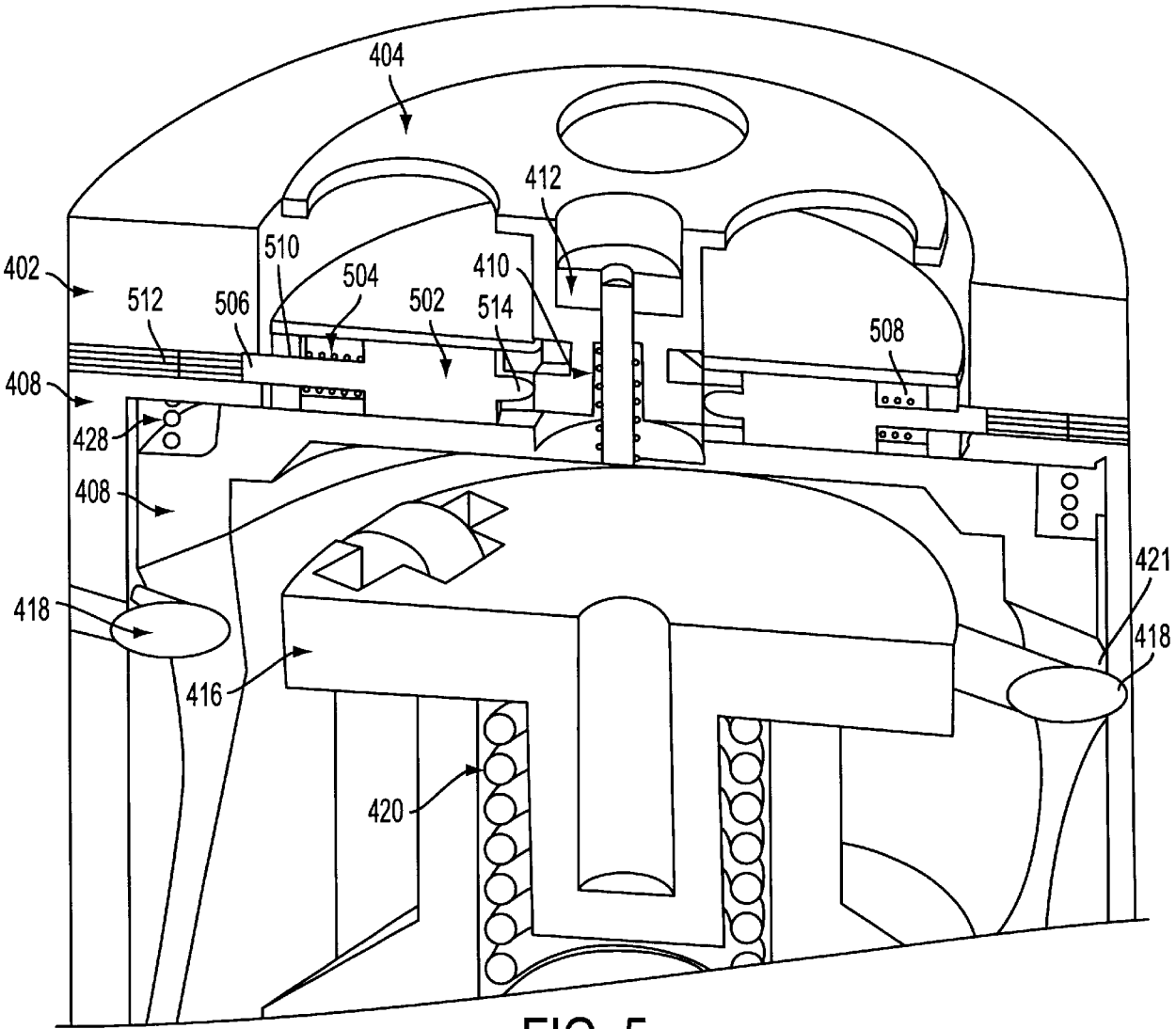
FIG. 5 illustrates an exploded view of the top portion of the first stage of the triggering system of FIG. 4.

FIG. 5 is an exploded view of the top portion of the first stage 204 of FIG. 4. Safety pins 502 are used to lock the first stage restraining arm shell 408 to the first stage body, 402, against the bias provided by a wave spring 428, when the device is in the armed condition. The safety pins prevent firing of the first stage 204 resulting from jarring such as by dropping the device. It should be noted that although the present exemplary working embodiment uses two safety pins, only one is needed, and more than two may be used.

Safety pin springs 504 are used to bias the safety pins 502 against the trigger 404. Safety pins 502 include respective tail portions 506, and head portions 514. Safety pins 502 are slidably accommodated within respective channels 508 in the first stage arm restraining shell 408. Each safety pin tail portion 506 is slidably accommodated within its respective channel 510 in the first stage arm restraining shell 408. Further, while the first stage 204 is in the armed condition, each safety pin tail portion 506 is additionally slidably accommodated into its respective channel 512 in the first stage body 402. The body of the trigger 404 prevents the safety pins from translating inward thereby maintaining a locked condition.

Returning to FIG. 4, the first stage spring restraining base 416 is restrained from any longitudinal motion with respect to the first stage body 402 by first stage restraining pins 418 (As seen in FIG. 5). It should be noted that although the present exemplary working embodiment uses two restraining pins, only one is needed to restrain the first stage spring restraining base from longitudinal motion with respect to the first stage body, and more than two may be used. Voids 421 (As seen in FIG. 5) in the walls of the first stage arm restraining shell 408 for accommodating respecting first stage restraining pins 418 enable relative motion between the first stage arm restraining shell 408 and the first stage body 402. The first stage spring 420 is held in a compressed position by the first stage spring retaining base 416 and the first stage spring retaining top 422, which are held in place by the first stage arms 424. The spring retaining top 422, has a beveled edge 426, which prevents the first stage arms 424 from locking against the spring retaining top 422.

It should be noted that although the present exemplary working embodiment uses three first stage arms, only one is needed, and more than three may be used.

Figure 6:
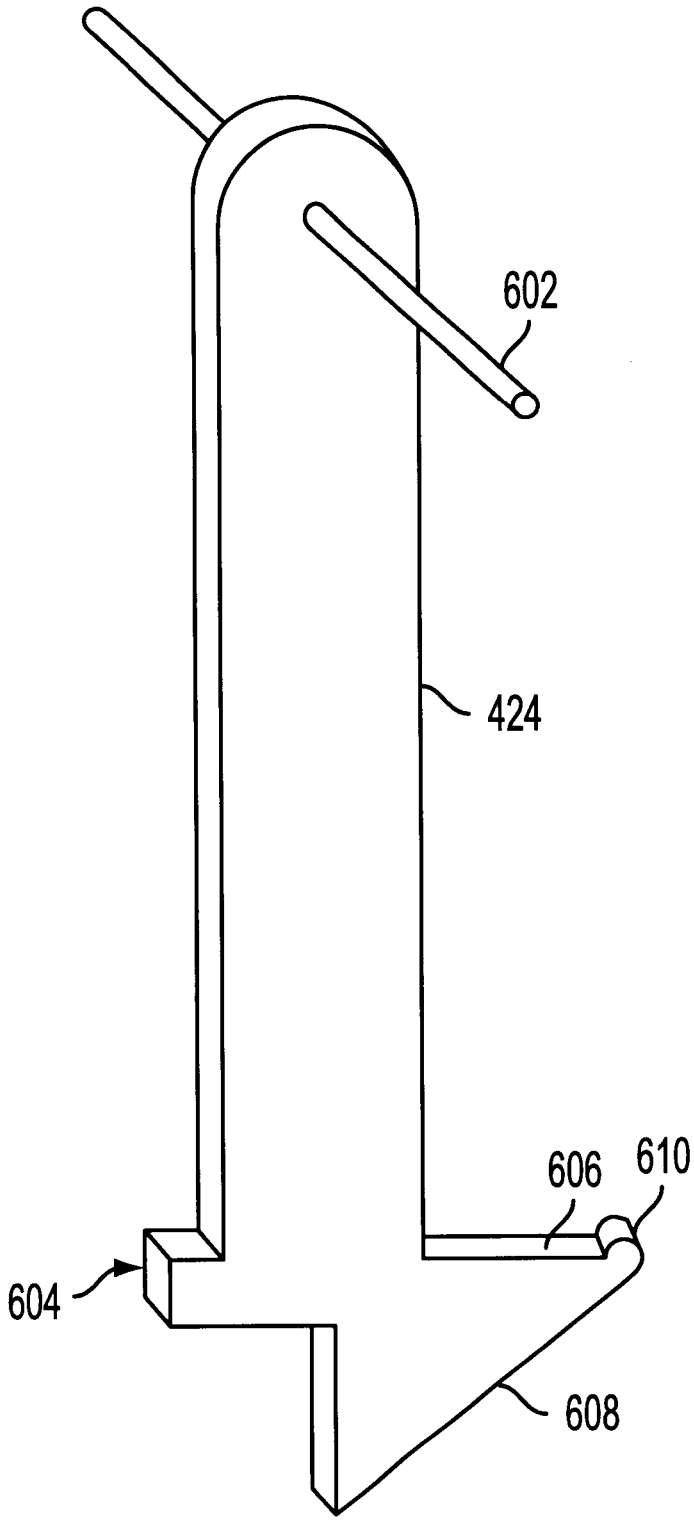
FIG. 6 illustrates a first stage arm in accordance with an exemplary embodiment of the present invention.

FIG. 6 is a view of a first stage arm 424. As seen in FIG. 6, the first stage arm 424 includes, a shaft feature 602 that is perpendicular to the arm's body, a first stage restraining shell surface 604, and a hook feature 608, having a first stage spring retaining top surface 606 having a bump 610. The shaft feature 602 attaches the first stage arm 424 to the spring retaining base 416 and permits the first stage arm 424 to rotate with respect to the first stage spring retaining base 416. As illustrated in FIG. 4, when the first stage 204 is in the armed condition, the first stage restraining shell surface 604 abuts against the first stage restraining shell 408. In the armed condition, the first stage arms 424 are restrained from rotating about their shaft feature (not shown) by the first stage arm restraining shell 408 abutting against the first stage restraining shell surface 604. Further, when the first stage 204 is in the armed condition, bump 610 on the first stage spring retaining top surface 606, abuts against the first stage spring retaining top 422 at a point beyond the beveled edge 426.

Figure 7:
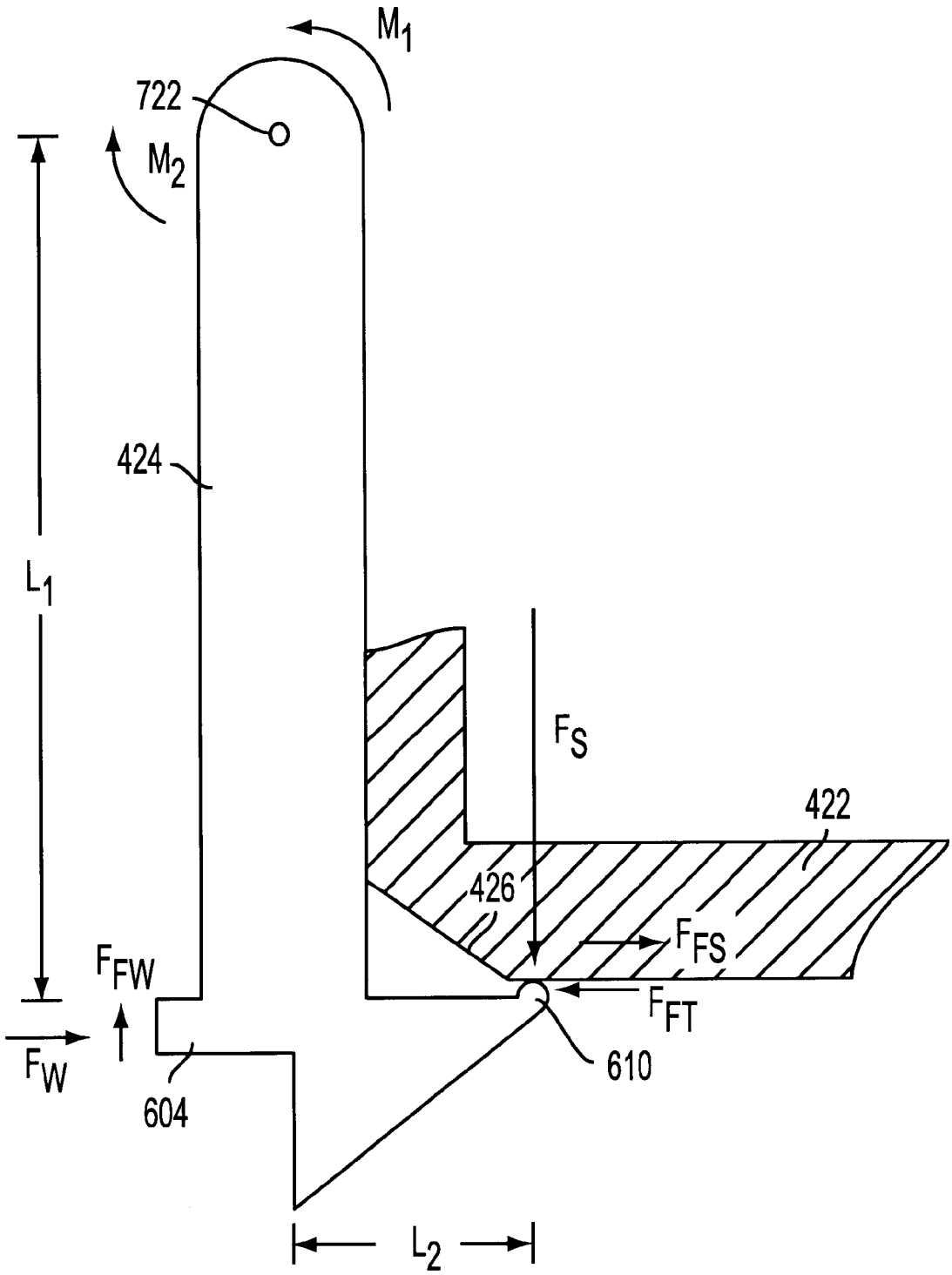
FIG. 7 illustrates a force and moment diagram of the first stage arm of the present invention.

FIG. 7 diagrams the forces acting on the first stage arm 424 when the first stage 204 is in the armed condition. The force, $F_s$, of the first stage spring retaining top 422 being biased against the first stage spring retaining top surface 606, resulting from the first stage spring 420, creates a large frictional force $F_{ft}$ between the first stage spring retaining top 422 and bump 610 on the first stage spring retaining top surface 606. The frictional force $F_{ft}$, inhibits relative movement between the first stage arm 424 and the first stage spring retaining top 422. It should be noted that although the present exemplary working embodiment uses three first stage arms, therefore the force, $F_s$, is actually ⅓ the total force provided by the first stage spring. Consequently, if more first stage arms are used, the amount of force, $F_s$, will be inversely proportional to the integer number of first stage arms.

The force $F_s$ creates a moment $M_1$ about point 722, wherein $M_1$ is equal to the magnitude of the force $F_s$ times the distance $L_2$, between point 722 and the point of contact between bump 610 and first stage spring retaining top 422. When the first stage 204 is in the armed condition, there is a force, $F_w$, provided from the first stage restraining shell surface 604 against the first stage arm restraining shell 408 (not shown). Similarly, the force $F_w$, creates a moment $M_2$ about point 722, wherein $M_2$ is equal to the magnitude of the force $F_w$ times the distance $L_1$, between point 722 and the point of contact between the first stage restraining shell surface 604 and the first stage arm restraining shell 408.

When the first stage 204 is in the armed condition, the first stage arm 424 it is not moving. Therefore the sum of the moments about point 722 is equal to zero. In other words:

$$\Sigma M = M_1 - M_2 = F_s L_2 - F_w L_1 = 0. \quad (1)$$

As seen in equation (1) above, the force on the wall $F_w$, may be decreased as $L_1$ becomes much larger than that of $L_2$. Please note that the moments created by the frictional forces $F_{fs}$ and $F_{fw}$ are negligible as compared with $M_1$ or $M_2$. Consequently, these moments have not been treated with respect to equation (1) above.

The frictional force $F_{fw}$, created by the force $F_w$, inhibits relative movement between the first stage arm 424 and the first stage arm restraining shell 408. In order to move the first stage arm 424 from the first stage spring retaining top 422 so that the first stage spring retaining top may be moved by the first stage spring 420, the frictional force $F_{fw}$ must be overcome by the force provided by the water pressure times the area of the diaphragm 214 in addition to the force provided by the wave spring 428. Therefore, in order to make the force $F_{fw}$ as small as possible, the force $F_w$ should be made as small as possible. Consequently, in order for the first stage 204 to fire, the water pressure must push the trigger 404 down such that the safety pins 502 slide radially inward so that the force from the water pressure in addition to the force from the wave spring 428 thereby provides a force sufficient to overcome $F_{fw}$. In order to ensure that the force from the water pressure and the wave spring may overcome $F_{fw}$, $L_1$ may be designed to be much larger than $L_2$ One will note that a wave spring 428 may be provided that has a large spring constant k. However, a wave spring should not be used in the system if its a spring constant k is too large, wherein the wave spring provides too much force on the first stage arm restraining shell 408 that would in turn impose such a force on the safety pins 502 as to prevent them from sliding radially inward. should not be used.

Figure 8:
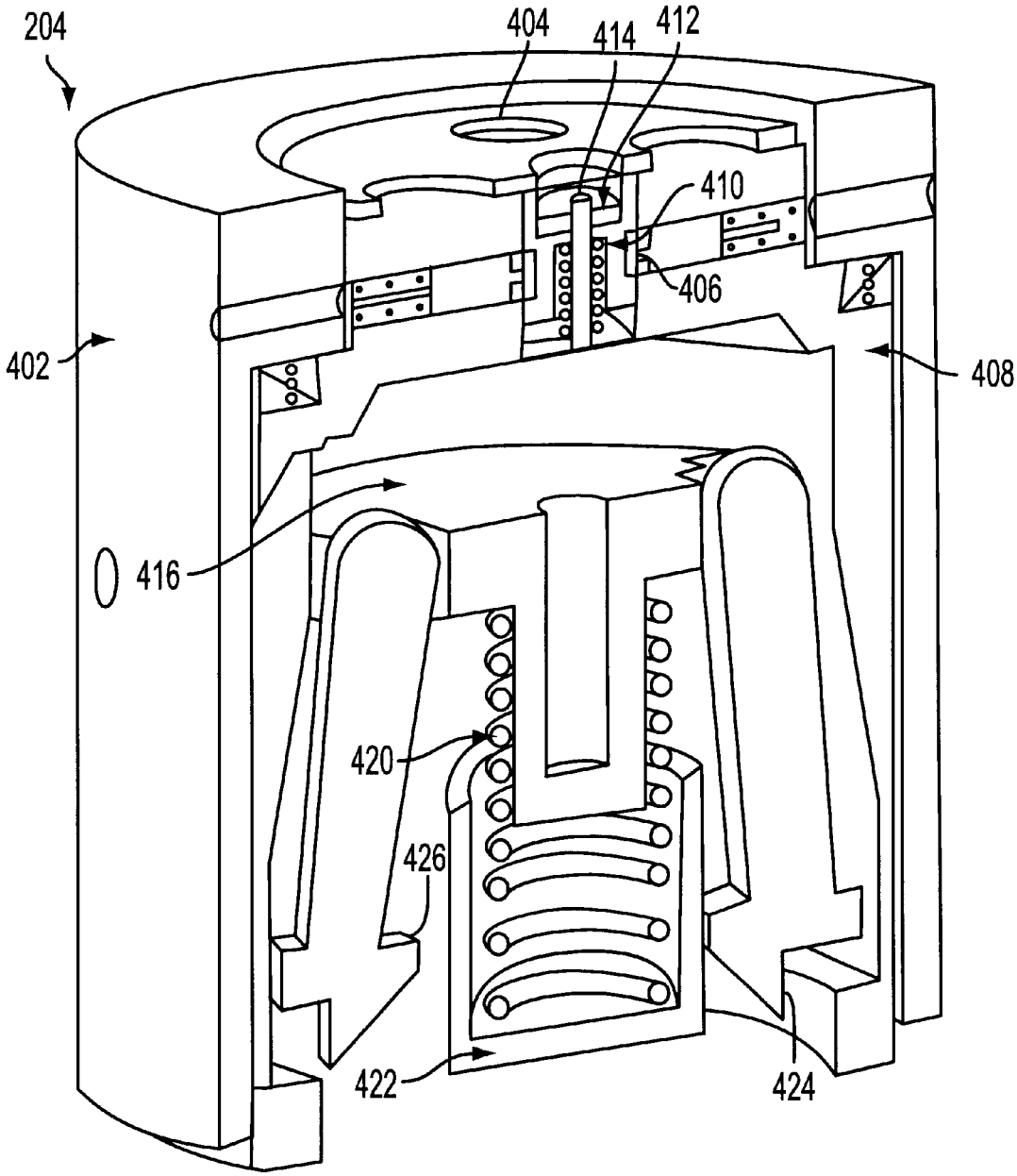
FIG. 8 illustrates a first stage of the triggering system in a fired condition in accordance with an exemplary embodiment of the present invention.

FIG. 8. illustrates the first stage of the triggering system 204 in a fired condition in accordance with the exemplary embodiment of the present invention.

The second stage of the triggering system will now be described with reference to FIG. 9 and FIG. 10.

Figure 9:
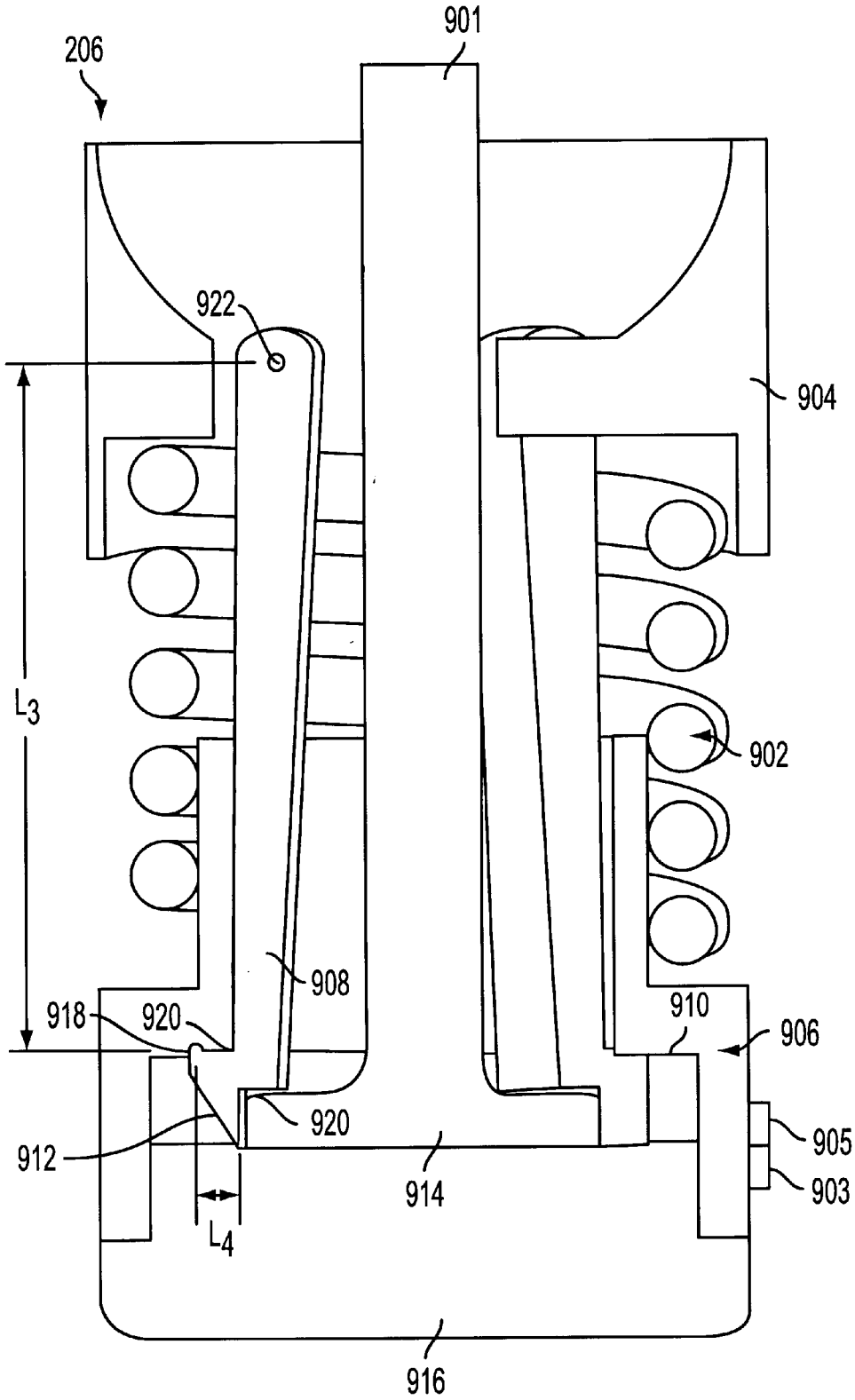
FIG. 9 illustrates a second stage of the triggering system in an armed condition in accordance with an exemplary embodiment of the present invention.

As illustrated in FIG. 9, the second stage 206 includes of a second stage spring 902, a second stage spring retaining base 904 and a second stage spring retaining top 906. The second stage body has two bands 903 and 905 for viewing through window 306 of housing 106. The two bands 903 and 905 are different in either color or pattern for easy recognition through window 306. When the first stage is in an armed state, band 903 is lined up with window 306, indicating to a user that the device is ready for use. On the contrary, when the first stage is in a fired state, band 905 is lined up with window 306, indicating to a user that the device has been fired.

The second stage spring 902 is held in compression by three second stage arms 908. It should be noted that although the present exemplary working embodiment uses three second stage arms, only one is needed to restrain the second stage spring, and more than two may be used. Similar to the first stage arms 424, the second stage arms 908 having a length $L_3$ are attached to the second stage spring retaining base 904 by a shaft feature (not shown) at point 922 on the second stage arm 908. Again, similar to the first stage arm 424, the distal end of the second stage arms 908 include a hook feature 912 having a bump 918 at a distance $L_4$ lateral from pivot point 922, wherein the pump 918 engages the surface 910 of the second stage retaining top 906. Similar to the spring retaining top 422, the surface 910 of the second stage retaining top 906 has a beveled edge 920, which prevents the second stage arms 908 from locking against the second stage retaining top 906.

In the exemplary working embodiment of the present invention, three second stage arms 908 hold the second stage restraint top 906 and second stage retaining base 904 together such that the second stage spring 902 is in compression. The second stage spring release rod 901 is located along the second stage springs center line and its distal end 914 holds the three second stage arms 908 apart. In the exemplary embodiment the distal end 914 of the second stage spring release rod 910 is disc shaped. The distal end 914 prevents the three second stage arms 908 from rotating inwards releasing the second stage spring 902. The cap 916 is used to transmit the second stage spring force to the push rod 214.

One skilled in the art would understand that a similar force analysis as that applied to the first stage arms 424 of the first stage 204, as described above, may be applied to the second stage arms 908 of the second stage 206. As such, the force imposed by the second stage spring 902 pressing the second stage restraint top 906 against the second stage arms 908, creates a frictional force that inhibits relative a movement between the second stage arms 908 and the distal end 914 of the second stage spring release rod 910. In order to move the second stage arms 908 from the distal end 914 so that the second stage restraint top 906 may be moved by the second stage spring 902, the frictional force must be overcome by the force provided by the first stage 204.

It should be noted that although the present exemplary working embodiment uses three second stage arms, only one is needed, and more than three may be used.

Figure 10:
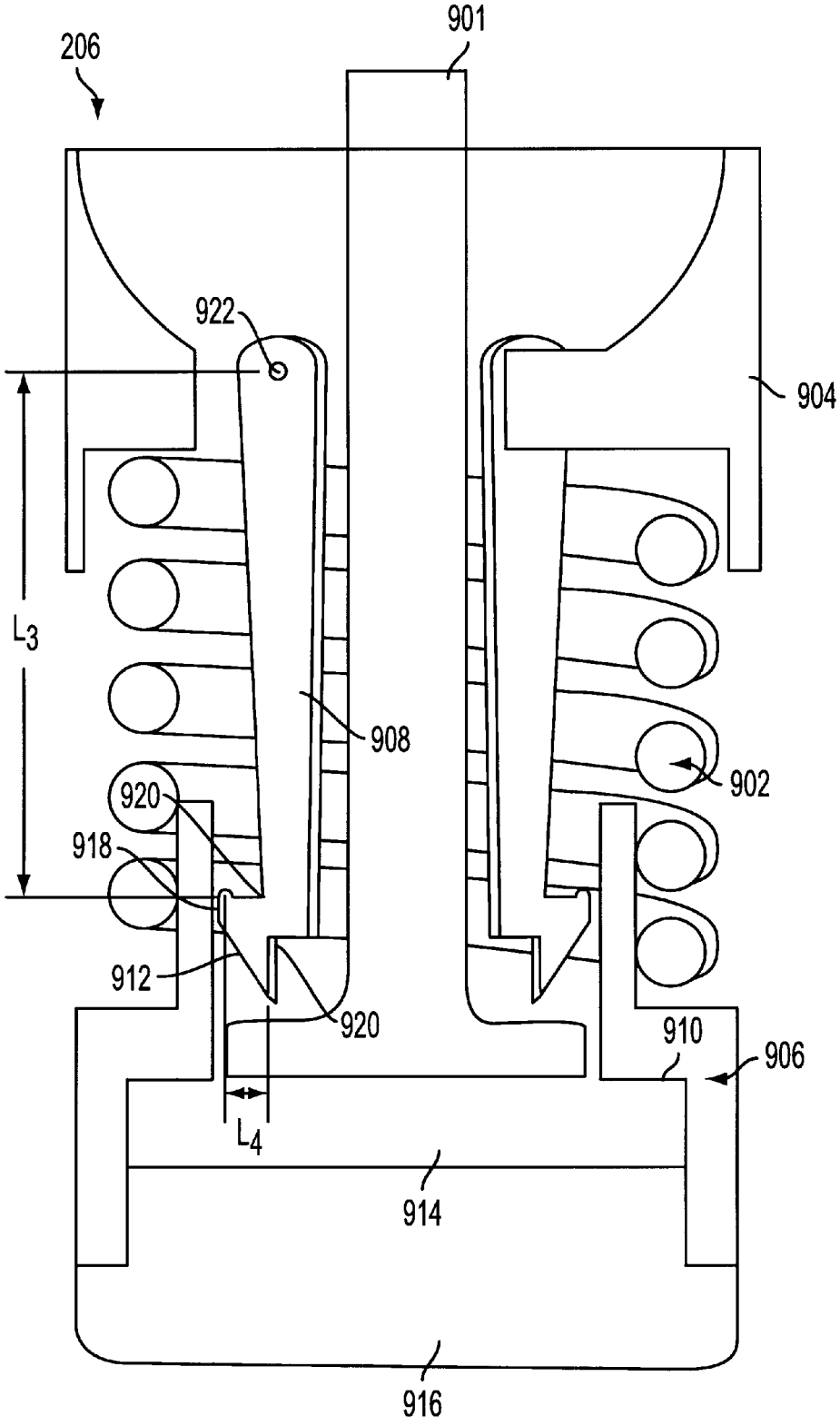
FIG. 10 illustrates a second stage of the triggering system in a fired condition in accordance with an exemplary embodiment of the present invention.

FIG. 10. illustrates the second stage 206 of the triggering system in a fired condition in accordance with the exemplary embodiment of the present invention.

It should be noted that although the present exemplary working embodiment uses two stages 204 and 206, and more than two may be used, wherein a plurality of stages, each similar to the second stage 206, and each stage increasing the resultant output force may be used.

Figure 12:
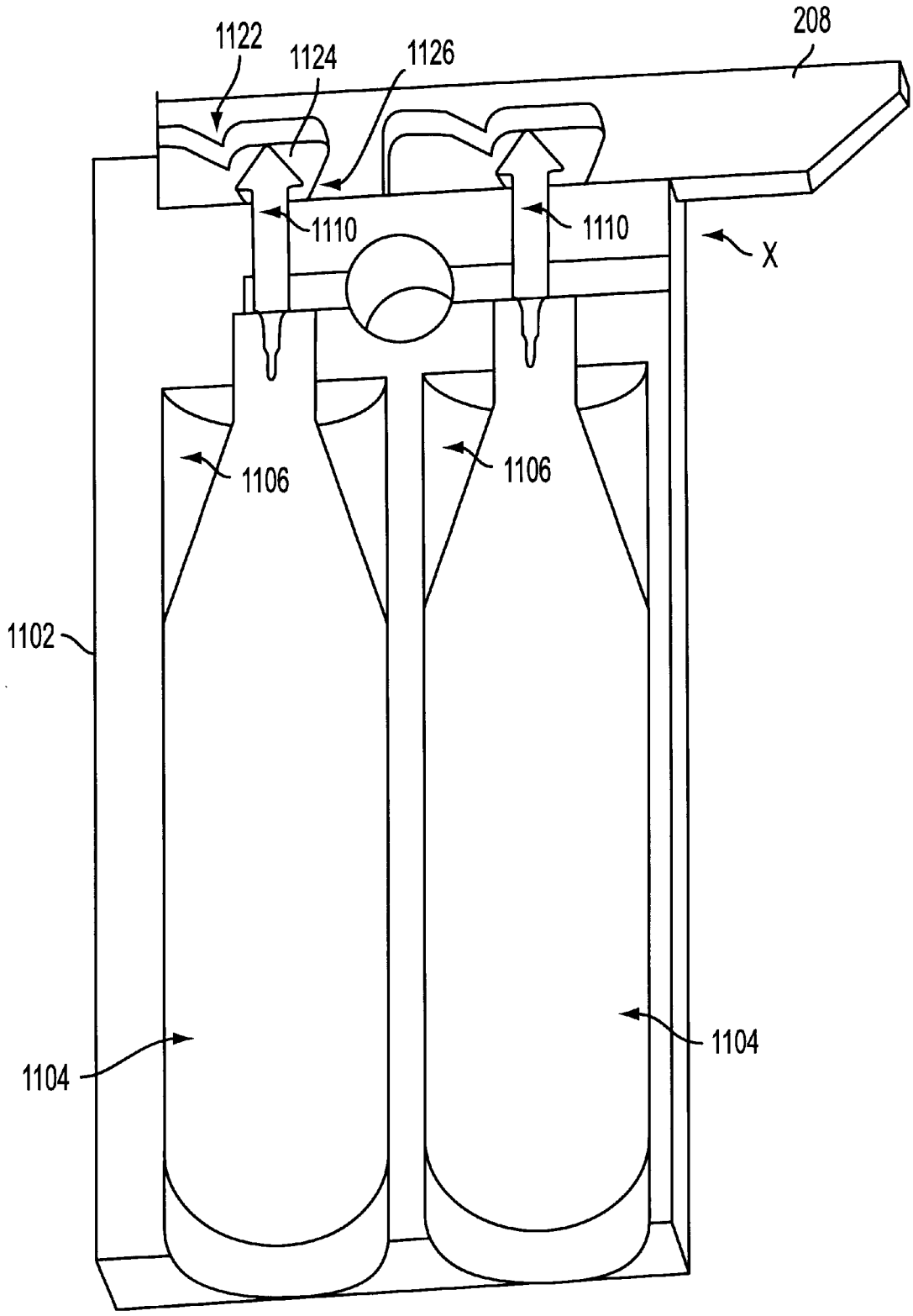
FIG. 12 illustrates a cartridge subassembly a period of time after firing in accordance with an exemplary embodiment of the present invention.
Figure 13:
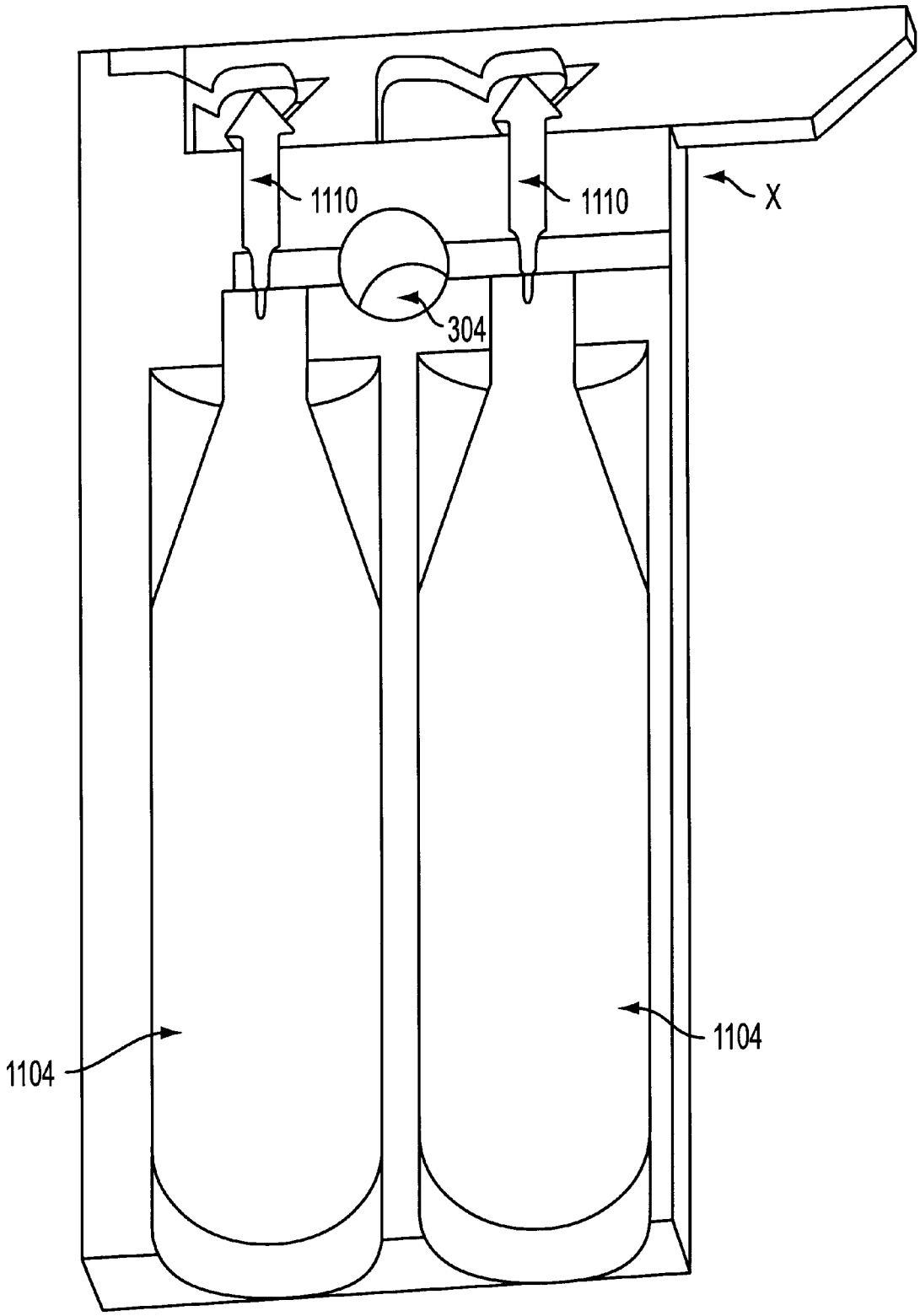
FIG. 13 illustrates a cartridge subassembly after a period of time that as illustrated in FIG. 12, in accordance with an exemplary embodiment of the present invention.

An exemplary embodiment of the cartridge subassembly will now be described with reference to FIG. 11 through FIG. 13.

Figure 11A:
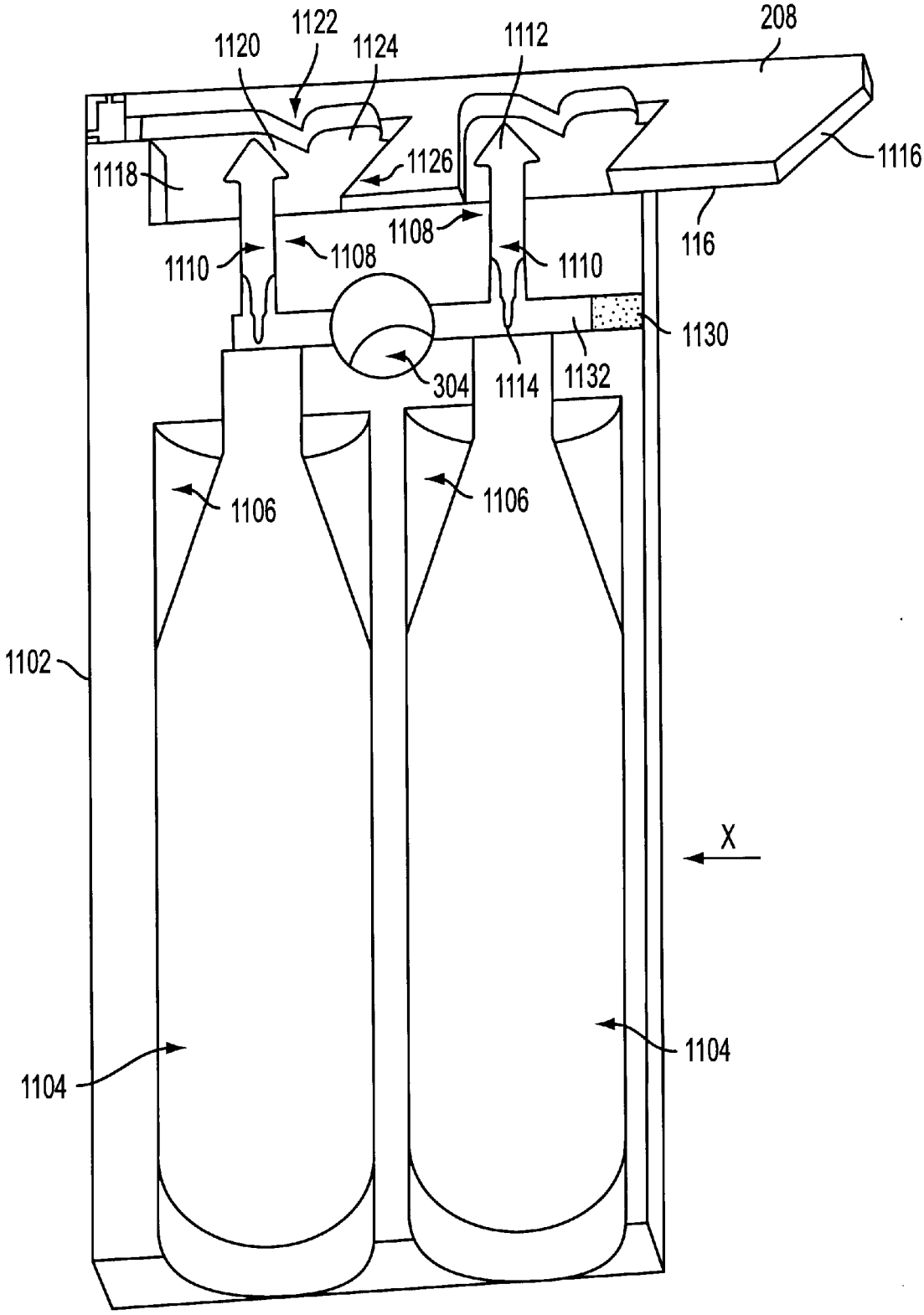
FIG. 11A illustrates a cartridge subassembly in an armed condition in accordance with an exemplary embodiment of the present invention.

As seen in FIG. 11A, the cartridge subassembly includes the cartridge housing 1102 which contains all of the cartridge components, two standard $CO_2$ cylinders 1104 are located in parallel cylindrical bores 1106, concentric with the center line of the cylinder bores are smaller diameter bores 1108 that contain pistons 1110. Plug 1130 is placed within a portion of the outer channel 1132 after manufacture of the cartridge housing to force fluid flow from punctured cylinders to be released from thee cartridge housing through the fluid purging system port 304. The pistons 1110 are designed with an engaging head 1112 for engaging the force transfer mechanism 208, and puncture tail 1114 for puncturing a respective cylinder 1104. It should be noted that although the present exemplary working embodiment uses two standard $CO_2$ cylinders, only one is needed, and more than two may be used. Consequently the same is true with regard to the respective cylindrical bores, and pistons.

The force transfer mechanism 208 is capable of moving along the x direction. The force transfer mechanism 208 includes a plane 1116 inclined at an angle $\phi$ with respect to the x direction of the force transfer mechanism 208. The force transfer mechanism 208 further includes a piston manipulation area 1118 that includes a first cavity 1120 for accommodating piston 1110, a first lip 1122 that is adjacent to the first cavity 1120, a second cavity 1124 for accommodating the piston 1110, and a second lip 1126 that is adjacent said second cavity 1124.

Figure 11B:
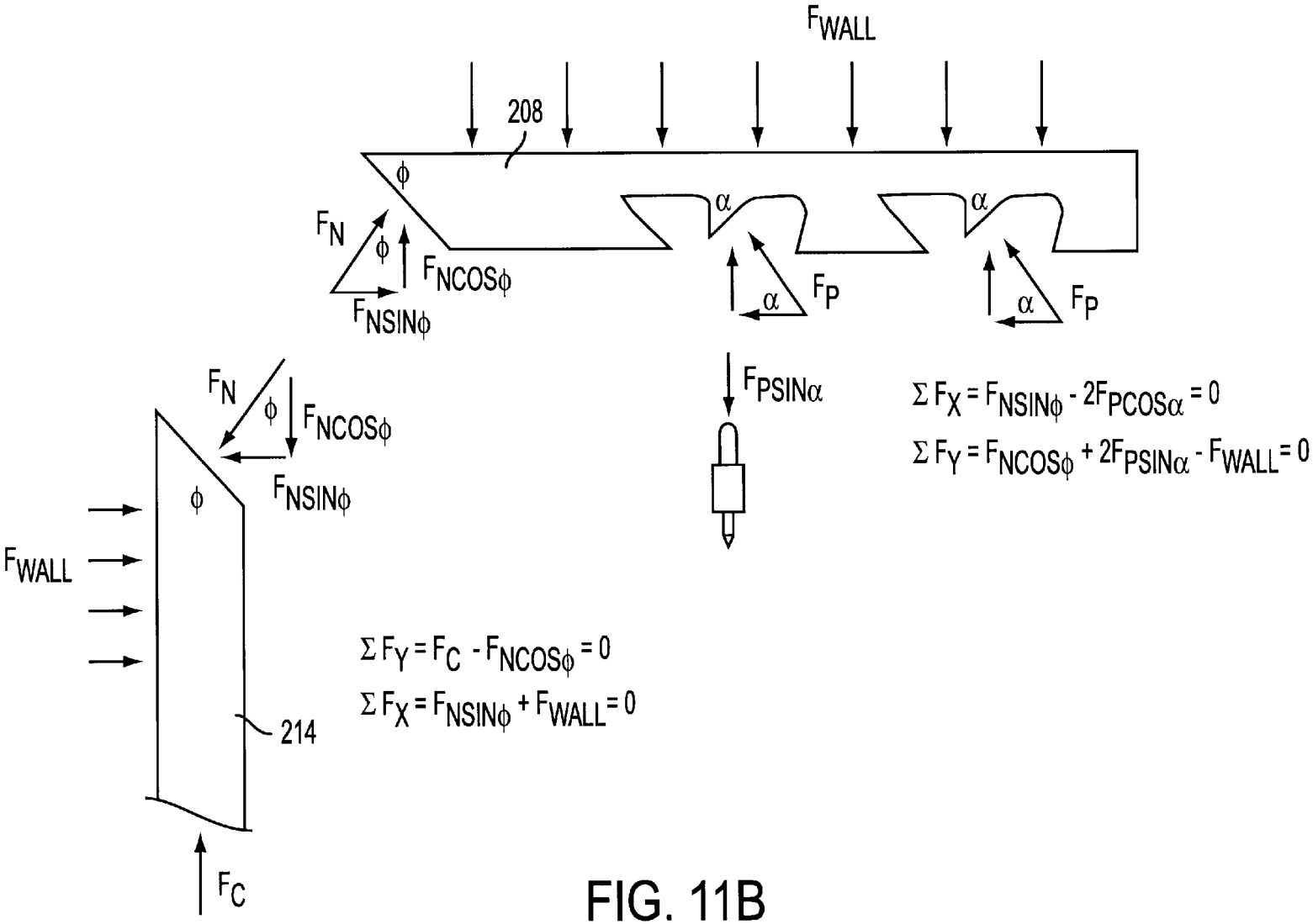
FIG. 11B illustrates a force diagram of the push rod and the force translation member of the present invention.

FIG. 11B illustrates a force diagram of the push rod 214 and the force translation member 208 of the present invention. The push rod 214 receives a force $F_c$ from the cap 916 of the second stage 206. Force $F_c$ is imputed to the force translation member 208 by way of the plane 1116 that is inclined at an angle $\phi$ with respect to the longitudinal direction of the force transfer mechanism 208.

As illustrated in FIG. 11B, one would note that by summing the x and y components of the forces acting on the push rod 214 resulting from the force $F_c$ would provide the following equations:

$$\Sigma F_y = F_c - F_n \cos \phi = 0. \quad (2)$$

$$\Sigma F_x = -F_n \sin \phi + F_{wall} = 0. \quad (3)$$

Similarly, as illustrated in FIG. 11B, one would note that by summing the x and y components of the forces acting on a piston 1110 resulting from the force from the force translation mechanism 208 would provide the following equations:

$$\Sigma F_x = F_n \sin \phi - 2F_p \cos \alpha = 0. \quad (4)$$

$$\Sigma F_y = F_n \cos \phi + 2F_p \sin \alpha - F_{wall} = 0. \quad (5)$$

One will note that, as illustrated in the above equation (5), the force acting on each respective piston is inversely proportionate to the integer number of pistons used in the system. Further, one will note that in the exemplary embodiment, the angle $\phi$ on the push rod 214 is 45°, thereby creating an equal angle on the force transfer mechanism 208. This angle $\phi$ may be increased or decreased for optimal design purposes. For example, as illustrated in the above equations (4) and (5), if the angle $\phi$ is increased, more force will be applied to the pistons 1110. However, as illustrated in the above equation (3), if the angle $\phi$ is decreased, less friction will be inhibiting movement of the push rod 214 as a result of a decrease in the force $F_{wall}$.

Returning to FIG. 11A, the piston manipulation area 1118 permits manipulation of the position of the piston 1110 in a direction normal to the longitudinal direction of the force transfer mechanism 208. Specifically, the first cavity 1120 accommodates piston 1110 while the triggering system 102 is in an armed state. The first lip 1122 is shaped, such as curved or angled, so as to engage the engaging head 1112 of the piston 1110 and move the piston 1110 down toward the cylinder 1104, as illustrated in FIG. 12. The second cavity 1124 accommodates piston 1110 for removal from the cylinder 1104. The second lip 1126 is shaped, such as curved or angled, so as to engage the engaging head 1112 of the piston 1110 and move the piston 1110 up away from the cylinder 1104 and into the second cavity 1124, as illustrated in FIG. 13.

Figure 14:
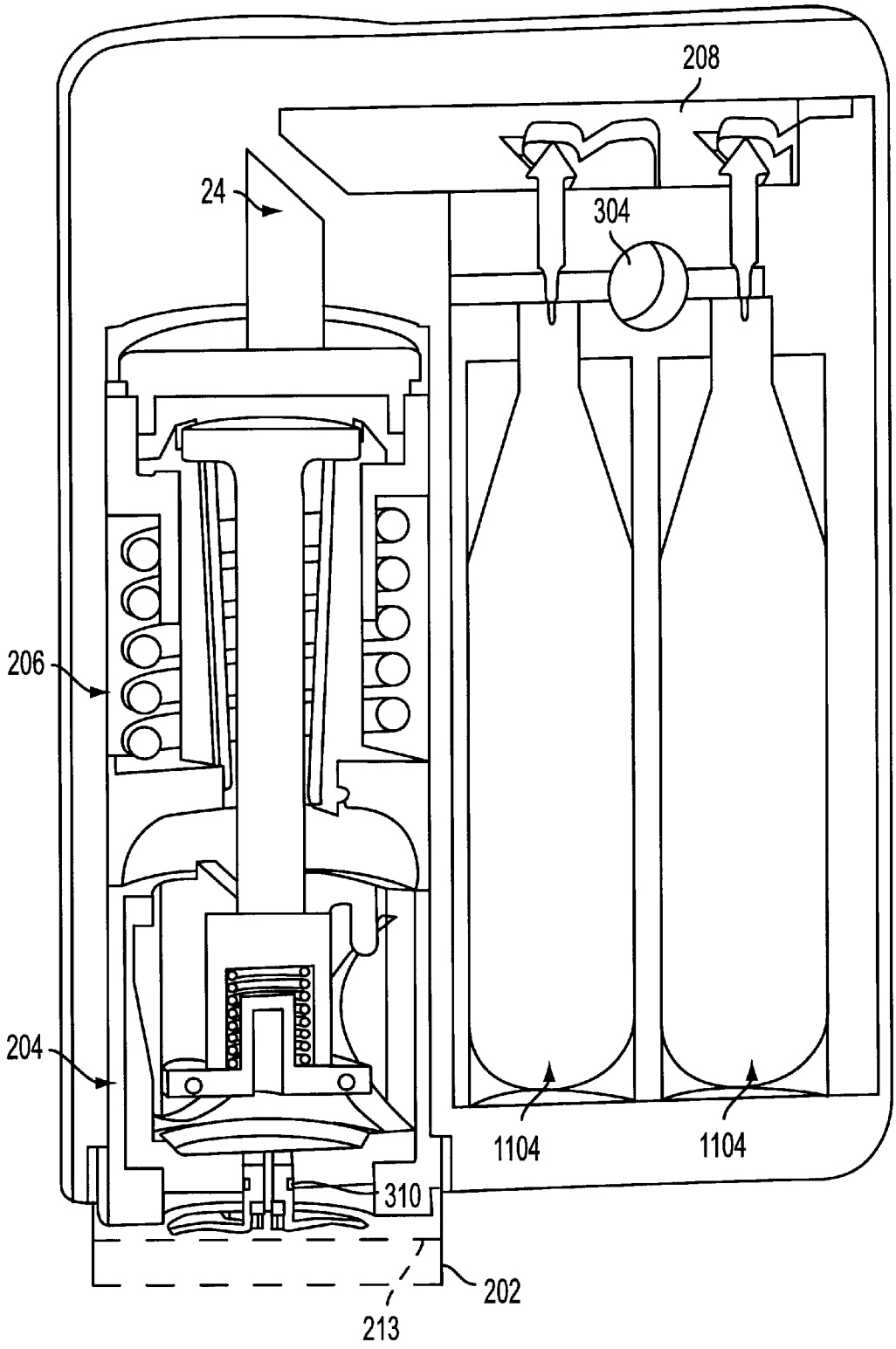
FIG. 14 illustrates a two-stage triggering system and a compressed gas cartridge purging system in an armed condition in accordance in with an exemplary embodiment of the present invention.

In operation, when the automatic inflation mechanism, in an armed state as illustrated in FIG. 14, is submersed in water to a predetermined depth, the hydrostatic pressure, acting on the diaphragm 213, produces a force that deflects (deforms) the diaphragm 213 so that it forces the trigger 404 to compress the trigger spring 410. Compression of the trigger spring 410 moves the trigger 404 an axial distance sufficient to permit the armed safety pins 502 to be forced into the circumferential groove 310 in the trigger's body. When the armed safety pins 502 are forced into the circumferential groove 310 in the trigger's body, the first stage arm restraining shell 408 is forced from the first stage body 402 by the wave spring 428.

The hydrostatic force, still present on the trigger 404, together with the force from the armed wave spring 228 force the first stage arms restraining shell 408 down so that the first stage arms 424 are no longer restrained. Forces acting on the first stage arms 424, as a result of the first stage spring 420, rotate the first stage arms 424 such that the first stage spring restraining top 422 is no longer restrained to hold the compressed first stage spring 420. The first stage spring 420 therefore releases its energy. This energy is the source for the first stage force.

Activation of the first stage 204 then activates the second stage 206. Specifically, the first stage spring releases its energy, thereby pushing the first stage spring restraining top 422 into to the second stage spring release rod 910. The relatively small force provided by the first stage spring restraining top 422 and applied to the second stage spring release rod 910 releases the second stage spring 902. Particularly, this force displaces the distal end 914 of the spring release rod 910 from its armed position. When the distal end 914 is axially displaced it no longer acts as a restraint for the second stage arms 908 and they are free to rotate inwards thereby releasing the second stage spring retainer top 906. Release of the second stage spring 902 produces the force that drives both the second stage retainer top 906 and cap 916 forward, applying a large force to push rod 214.

The push rod 214 imputes the force from the second stage to the force transfer mechanism 208. The force transfer mechanism 208 then moves in the A direction wherein the piston engaging head 1112 engages the first lip 1122 of the force transfer mechanism 208. As the force transfer mechanism 208 continues in the A direction, the first lip 1122 forces the piston 1110 downward such that the puncture tail 1114 of the piston 1110 punctures the $CO_2$ cartridge 1104. At this point, although the $CO_2$ cartridge 1104 has been punctured, the $CO_2$ within the cartridge may be impeded from escaping the cartridge because the puncture tail 1114 is residing in the newly punctured hole. To alleviate this problem, the force transfer mechanism 208 continues to move in the A direction, wherein the second lip 1126 engages the engaging head 1112, thereby forcing the piston upward such that the puncture tail 1114 of the piston 1110 exits the $CO_2$ cartridge 1104. The released $CO_2$ exits the cartridge and the housing 106 through channel 1128 and eventually the fluid exit port 308.

Of course, it should be understood that a wide range of changes and modifications can be made to the preferred embodiment described above. It is therefore intended that the foregoing detailed description be regarded as illustrative rather than limiting, and that it be understood that it is the following claims, including all equivalents, which are intended to define the scope of this invention. Other embodiments are within the scope of the following claims.

What is claimed is:

1. A force transfer mechanism having a length and a width, said force transfer mechanism being longitudinally moveable responsive to a force from a lateral direction, said force transfer mechanism comprising:

a plane inclined at an angle with respect to the longitudinal direction of said force transfer mechanism, said plane receiving said force from a direction lateral to said force transfer mechanism; and a piston manipulation area comprising:

a first cavity for accommodating a piston that is moveable in a direction perpendicular to the longitudinal direction of said force transfer mechanism;

a first lip adjacent said first cavity, said first lip shaped so as to move said piston for a predetermined distance, in a first direction normal to the longitudinal direction of said force transfer mechanism, when said force transfer mechanism is longitudinally moved a first predetermined distance in response to said force;

a second cavity for accommodating said piston that is moveable in a direction perpendicular to the longitudinal direction of said force transfer mechanism, said first cavity and said second cavity being separated in a longitudinal direction by said first lip;

a second lip adjacent said second cavity, said lip shaped so as to move said piston for a predetermined distance, in a second direction normal to the longitudinal direction of said force transfer mechanism, said second direction normal to the longitudinal direction of said force transfer mechanism being opposite to said first direction normal to the longitudinal direction of said force transfer mechanism, after said force transfer mechanism has longitudinally moved a first predetermined distance in response to said force, and when said force transfer mechanism is longitudinally moved a second predetermined distance in response to said force.

2. The force transfer mechanism of claim 1, further comprising:

a plurality of piston manipulation areas.

* * * * *